United States Patent [19]

Hagewood

[11] Patent Number: 5,033,173

[45] Date of Patent: Jul. 23, 1991

[54] YARN HANDLING UNIT FOR A TEXTILE WARPING SYSTEM

[75] Inventor: John F. Hagewood, Mathews, N.C.

[73] Assignee: McCoy-Ellison, Inc., Monroe, N.C.

[21] Appl. No.: 558,316

[22] Filed: Jul. 24, 1990

Related U.S. Application Data

[60] Division of Ser. No. 457,335, Dec. 27, 1989, Pat. No. 4,984,341, Continuation-in-part of Ser. No. 252,497, Sep. 30, 1988, Pat. No. 4,924,567.

[51] Int. Cl.[5] ..... D02H 13/00

[52] U.S. Cl. ..... 28/190

[58] Field of Search ..... 28/185, 187, 172, 271, 28/241, 242, 245; 226/118, 119; 242/75.5, 131, 131.1

[56] References Cited

U.S. PATENT DOCUMENTS 4,852,225 8/1989 Hagewood et al. ..... 28/242 X

*Primary Examiner*—Werner H. Schroeder
*Assistant Examiner*—John J. Calvert
*Attorney, Agent, or Firm*—Shefte, Pinckney & Sawyer

[57] ABSTRACT

A yarn handling unit in a textile warping system having a plurality of rolls for training of a plurality of yarns to travel in side-by-side relation in series peripherally about the rolls, such rolls extending outwardly in a cantilevered manner from each opposite side of a central frame.

2 Claims, 4 Drawing Sheets

YARN HANDLING UNIT FOR A TEXTILE WARPING SYSTEM

CROSS-REFERENCE TO RELATED APPLICATIONS

This is a division of copending U.S. patent application Ser. No. 457,335, filed Dec. 27, 1989, for "APPARATUS FOR CONTROLLING TENSION IN A TRAVELING YARN", now U.S. Pat. No. 4,984,341 which is a continuation-in-part of U.S. Pat. application Ser. No. 252,497, filed Sept. 30, 1988, entitled "APPARATUS FOR CONTROLLING TENSION IN A TRAVELING YARN," now U.S. Pat. No. 4,924,567.

BACKGROUND OF THE INVENTION

The present invention relates generally to apparatus for controlling tension in a traveling yarn or the like and, more particularly, to such a yarn tension control apparatus adapted for disposition in a textile warping system intermediate a yarn creel and a warp beaming machine.

In virtually all systems involving the handling of yarn and similar strand-like materials, it is a characteristic requirement that the tension conditions in the material be controlled in order to best insure high quality results. This is particularly true in the handling of traveling yarns in typical textile manufacturing systems. Conventionally, the control of yarn tension in such operations has been commercially achieved by imposing an essentially fixed restraint, drag or load exerting a frictional force on the advancing strand. Disadvantageously, tension control devices operating in this manner provide only moderate effectiveness in maintaining yarn tension within a desirable range and are essentially effective primarily in merely maintaining a minimum tension in the yarn. Specifically, the restraint imposed by such devices on the traveling yarn is effective to compensate for tension losses by maintaining a minimum restraint against yarn travel. However, such devices effectively magnify tension increases in the yarn, rather than compensating for and offsetting such fluctuations, which may sometimes result in yarn breakage.

In textile warping systems, a plurality of textile yarns are fed from a creel generally in side-by-side relation to a warp-beaming machine by which the yarns are wound side-by-side onto a spool or beam in preparation for subsequent feeding of the yarns to a weaving, warp-knitting or similar fabric-forming apparatus. As in any other warp-preparation operation within the textile industry, it is important that the individual yarns be wound onto the warp beam by the beaming machine at a substantially uniform tension. For this purpose, it is conventional to incorporate a tensioning mechanism of the above-described type in advance of the warp beaming machine for imposing a frictional drag on the yarns as they enter the beaming machine.

Another consideration in the design of textile warping systems is the periodic necessity of interrupting the normally continuous warping operation, for example, when any one of the traveling yarns breaks or for other reasons experiences a significant loss in tension activating a stop motion arrangement of the warping equipment. For economic reasons, it is desirable to operate warping systems at an operating speed, i.e. the traveling speed of the yarns, as high as practicably possible. Thus, whenever stoppage of the warping system is necessary, it is not practical or possible to effect immediate stoppage of the traveling yarn movement. Accordingly, warping systems are conventionally designed with the warp beaming machine spaced a sufficient distance from the stop motion arrangement in relation to the normal yarn traveling speed and the rate at which the system is capable of braking to a complete stop so as to insure that system stoppages are completed in the event of a yarn breakage before the broken yarn or yarns are taken up by the warp beaming machine. As will be understood, this manner of construction substantially increases the overall length of warping equipment which is considered highly disadvantageous by users because of the substantial floor space required.

SUMMARY OF THE INVENTION

It is accordingly an object of the present invention to provide an improved apparatus for controlling tension in a traveling yarn, such as in a textile warping system, which avoids the disadvantages of the prior art. It is a specific object of the present invention to provide such a yarn tension controlling apparatus which imposes only a minimal frictional drag on the traveling yarn. It is a further object of the present invention to provide a yarn tension controlling apparatus which also functions to accumulate a sufficient length of the traveling yarn such that, when utilized in a warping system, the present apparatus enables a reduction in the overall length of, and floor space required by, the warping equipment.

Briefly summarized, the yarn tension controlling apparatus of the present invention includes an idler roll and a driven roll arranged for training of the traveling yarn in series peripherally about the rolls. The driven roll is rotatably mounted about a stationary axis for driving the traveling movement of the yarn. The idler roll is rotatably mounted about an axis movable in a defined path with respect to the driven roll for driven rotation by the traveling movement of the yarn and for movement also in opposite directions along the path in response to tension increases and decreases in the traveling yarn. A biasing arrangement is provided for applying a biasing force which is generally constant at each position of the idler roll along its defined path for urging movement of the idler roll in the path into tensioning engagement with the yarn. A sensing device is provided for detecting movement of the idler roll in each direction along the path from a defined neutral point thereon. The sensing device is operatively associated with the driven roll for varying its yarn driving speed in response to movements of the idler roll along its defined path to compensate for yarn tension increases and decreases.

Preferably, the sensing device is an electronic position transducer having a potentiometer arranged for sensing the degree of movement of the idler roll from its neutral point and for actuating increases and decreases of the yarn driving speed of the driven roll to a corresponding degree sufficient to adjust the tension in the traveling yarn at the idler roll to return it to its neutral point.

In one embodiment, the idler roll is arranged for movement in a horizontal linear path parallel to the stationary axis of the driven roll. Preferably, the rolls are spaced horizontally from one another a sufficient distance for accumulation of a sufficient length of the traveling yarn between an upstream supply location and a downstream delivery location to accommodate a stoppage of the apparatus at a predetermined normal rate of braking.

In a second embodiment, the idler roll is arranged to move in an arcuate path centered about the stationary axis of the driven roll, with the neutral point of the arcuate path preferably being generally vertically aligned with the stationary axis of the driven roll for movement of the idler roll from its neutral point with an at least initially predominantly horizontal component of movement.

In either embodiment, the idler roll is preferably connected operably for movement with a piston disposed within a pressurized fluid cylinder for biasing of the idler roll as aforementioned.

DESCRIPTION OF THE PREFERRED EMBODIMENT

Figure 1:
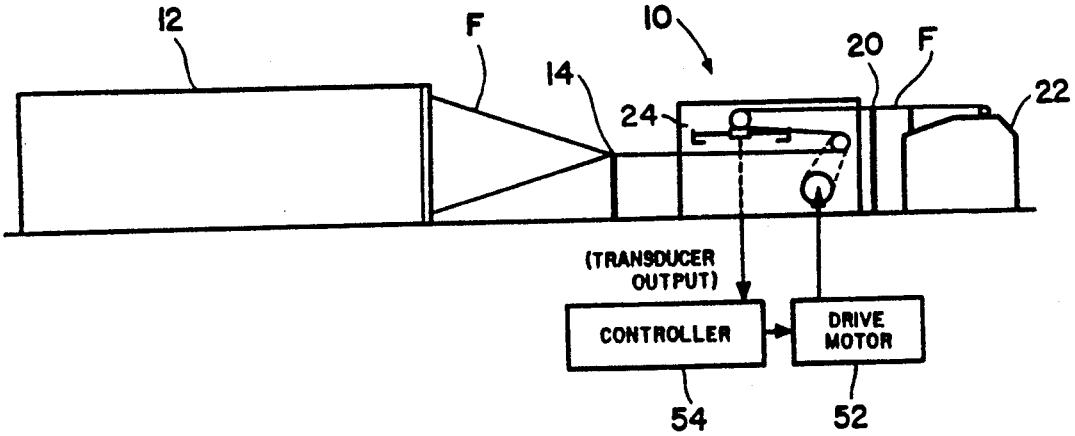
FIG. 1 is a schematic side elevational view of a warping system incorporating the preferred embodiment of the yarn tension controlling apparatus of the present invention.

Referring now to the accompanying drawings and initially to FIG. 1, a yarn tension controlling apparatus according to the preferred embodiment of the present invention is shown generally at 10 as preferably embodied in a textile warping system wherein a creel, representatively indicated at 12, supports a plurality of individual packages of yarns which are fed as represented at F generally in side-by-side relation through an eyeboard 14 to travel therefrom through the tension controlling apparatus 10, and a comb or reed 20, to warp beaming machine 22, commonly referred to as a warper. While the present yarn tension controlling apparatus 10 is herein illustrated and described in its preferred use as part of the described warping system, such description is only for purposes of illustration in order to provide an enabling disclosure of the best mode of the present invention. Those persons of skill in the art will readily recognize that the present yarn tension controlling apparatus 10 is of a broad utility and is therefore susceptible of many other applications and embodiments whenever it is desired to control the tension in a traveling yarn. In this regard, the use of the term "yarn" herein is intended to generically encompass substantially any continuous length textile material.

Figure 2:
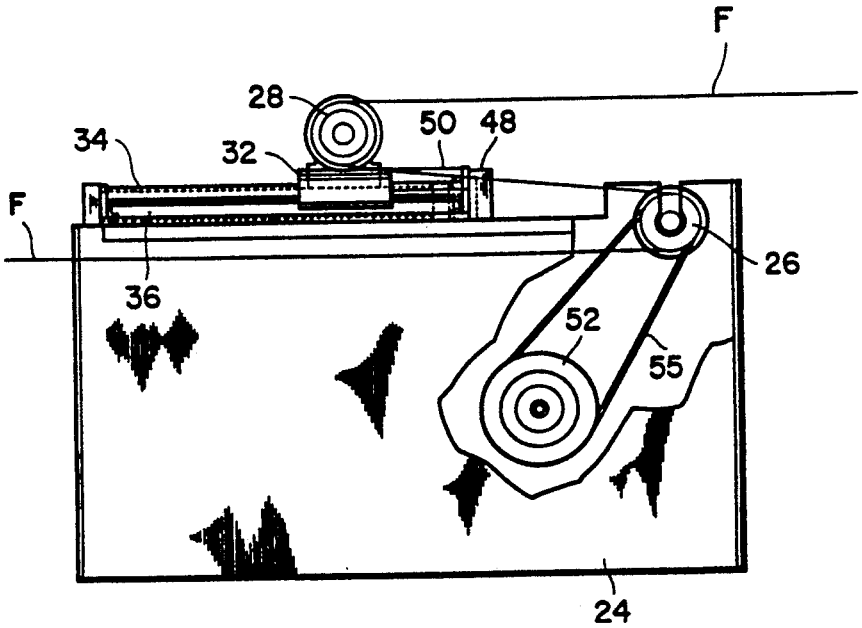
FIG. 2 is a more enlarged and detailed side elevational view of the present yarn tension controlling apparatus of FIG. 1.
Figure 3:
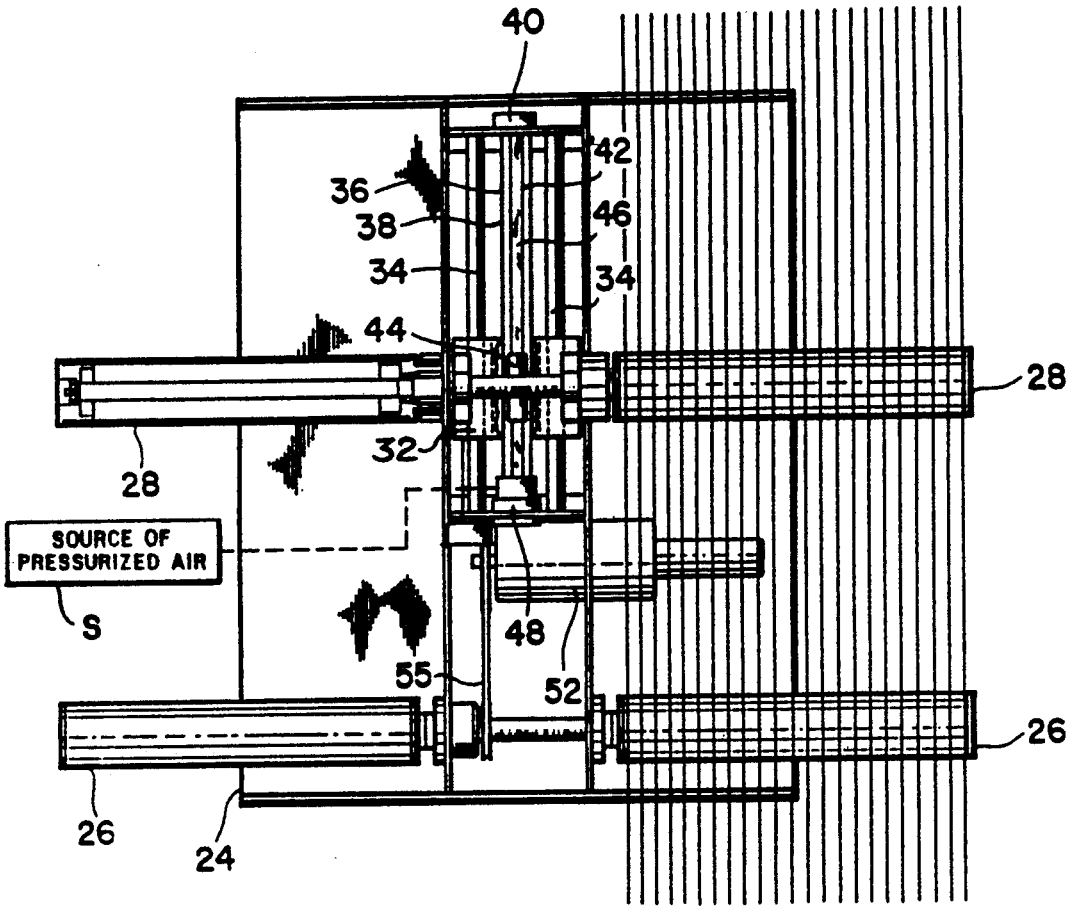
FIG. 3 is a top plan view of the yarn tension controlling apparatus of FIG. 2.
Figure 4:
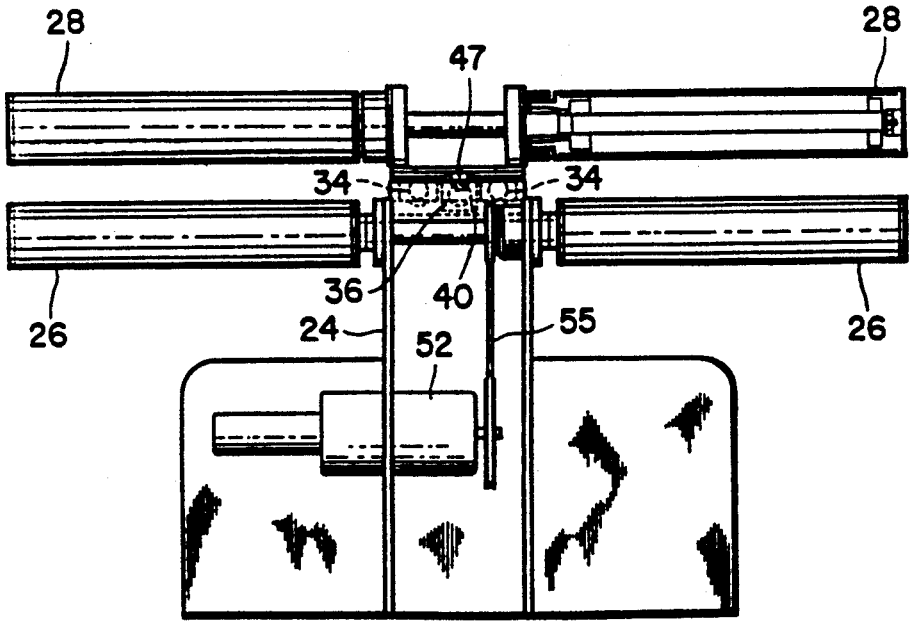
FIG. 4 is an end elevational view of the yarn tension controlling apparatus of FIG. 2.

The present yarn tension controlling apparatus 10 is shown in greater detail in FIGS. 2, 3 and 4. Basically, the tension controlling apparatus 10 has an upstanding central frame 24 by which a driven roll 26 and an idler roll 28 are rotatably supported to extend outwardly in cantilevered fashion from each opposite side of the frame 24 for training of the yarns F in sequence peripherally about the rolls 26, 28, as shown. This construction facilitates operator access to the yarns for ease of yarn thread-up and like operations. The driven roll 26 is mounted in a fixed disposition for rotation about a stationary axis adjacent the forward end of the frame 24 and is driven by a variable speed motor 52 via a drive belt 55. The idler roll 28 is rotatably mounted at a slightly higher elevation than the driven roll 26 on a movable shelf 32 supported within the frame 24 on a pair of guide rods 34 fixed to the frame to extend horizontally in parallel relation to one another and to the path of travel of the yarns F, whereby the axis of rotation of the idler roll 28 is movable toward and away from the driven roll 26 in a substantially horizontal path.

A piston-and-cylinder assembly 36 is mounted within the frame 24 intermediate and in parallel relation with the guide rods 34 immediately beneath the movable shelf 32. The piston-and-cylinder assembly 36 basically includes a cylindrical housing 38 containing a reciprocable piston (not shown) dividing the housing interior into two operating chambers at opposite sides of the piston, with fittings 40 being fixed at opposite ends of the housing 38 for admitting and exhausting pressurized operating fluid, preferably pressurized air, into and from the respective chambers. A longitudinal slot 42 is formed in the upwardly facing surface of the cylindrical housing 38 through which a slide member 44 disposed exteriorly of the housing 38 is connected to the piston for sliding movement therewith along the slot 42, a sealing band 46 extending from each opposite end of the slide member 44 in slidable sealing relationship with the slot 42 for sliding movement with the slide member 44 to sealingly close the remaining extent of the slot 42. A clevis 47 affixed to the underside of the movable shelf 32 is attached to the slide member 44 for unitary movement of the movable shelf 32 and the idler roll 28 with the slide member 44 and the piston. Piston-and-cylinder assemblies of the described type are known and commercially available and, accordingly, need not be more fully described herein. Moreover, those persons skilled in the art will recognize that many alternative forms of double acting piston-and-cylinder assemblies may also be utilized instead of the piston-and-cylinder assembly 36.

An electronic position transducer 48 is mounted at the forward end of the frame 24 in line with the piston-and-cylinder assembly 36. The transducer 48 is of the type having a potentiometer (not shown) to which an extendable and retractable cable 50 is operatively connected, the extending free end of the cable 50 being attached to the movable shelf 32 immediately beneath the idler roll 28 whereby the potentiometer is enabled to monitor the position of the idler roll 28 in its horizontal path of travel and, in turn, to produce a variable voltage output as a function of the degree to which the cable 50 is withdrawn from the transducer housing 48.

As will thus be understood, the driven rotation of the roll 26 imparts traveling movement to the yarns F, which in turn drives rotation of the idler roll 28. The forwardmost fitting 40 of the piston-and-cylinder assembly 36 is supplied with pressurized air from a suitable source of supply, representatively indicated at S, to apply a biasing force urging movement of the idler roll 28 within its horizontal path of movement away from the driven roll 26 to maintain the idler roll 28 in engagement with the yarns F. As will be understood, the biasing force exerted by the piston-and-cylinder assembly 36 on the idler roll 28 is essentially constant at each position of the roll 28 along its horizontal path of movement, the amount of the biasing force being selected to be substantially equivalent to the desired amount of tension in the traveling yarns F whereby the prevailing yarn tension counteracts the biasing force. So long as the tension prevailing in the yarns F remains constant at the desired tension level, the idler roll 28 will not move within its horizontal path of movement either toward or away from the driven roll 26. However, if the prevailing tension in the yarns F increases, the increased yarn tension overcomes the biasing force to cause the idler roll 28 to move along its path of movement toward the driven roll 26. Likewise, in the event of a decrease in the prevailing tension in the yarns F, the biasing force overcomes the prevailing yarn tension to cause the idler roll 28 to move away from the driven roll 26. Correspondingly, the cable 50 is retracted within or withdrawn from the transducer housing whereby the voltage output from the transducer 48 changes to a degree corresponding to the degree of movement of the idler roll 28.

As representatively shown in FIG. 1, the operational speed of the drive motor 52 to the driven roll 26 is controlled by a programmable microprocessor 54 or other suitable controller. According to the present invention, the variable voltage output of the transducer 48, representing movement of the idler roll 28 toward and away from the driven roll 26 in response to increases and decreases, respectively, in the prevailing tension in the yarns F, is supplied to the microprocessor 54 and the microprocessor 54 is programmed to correspondingly vary the driven axial speed of the driven roll 26 to compensate for such tension fluctuations. Specifically, assuming the prevailing tension in the traveling yarns F remains constant at a predetermined desired amount of tension, the idler roll 28 should assume and not move from a corresponding "neutral" position intermediately along its horizontal path of movement. The microprocessor 54 is programmed to control the drive motor 52 to decrease the driven axial speed of the driven roll 26 to a sufficient degree in response to recognition by the transducer 48 of movement of the idler roll 28 from the neutral position in a direction away from the driven roll 26 to compensate for the amount of the thusly-indicated decrease in the yarn tension as a function of the degree of such movement of the idler roll 28 represented by the amount of change in the voltage output of the transducer 48, thereby to return the idler roll 28 to its neutral position. Conversely, the microprocessor 54 is similarly programmed to operate the drive motor 52 to increase the driven axial speed of the driven roll 26 to a sufficient degree in response to recognition by the transducer 48 of movement of the idler roll 28 from its neutral position in a direction toward the driven roll 26 to compensate for the amount of the thusly-indicated increase in the tension in the yarns F as a function of the degree of such movement of the idler roll 28 represented by the amount of change in the voltage output of the transducer 48, thereby to return the idler roll 28 to its neutral position. Variation of the driven speed of the driven roll 26 in this manner serves to maintain the yarn tension substantially constant and, in turn, maintain the idler roll 28 essentially at its predetermined neutral location.

Figure 5:
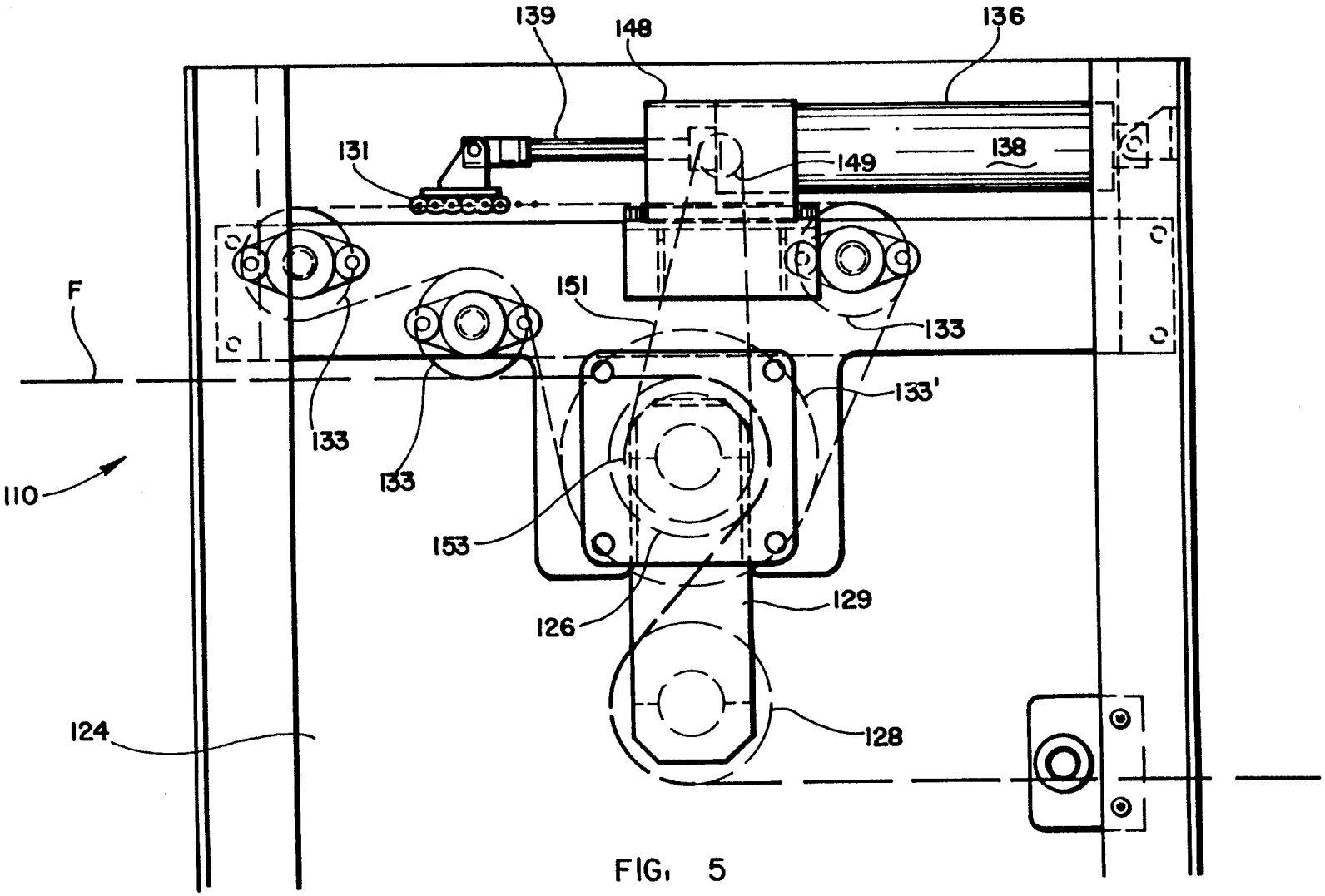
FIG. 5 is a side elevational view of an alternate embodiment of the yarn tension controlling apparatus of the present invention.
Figure 6:
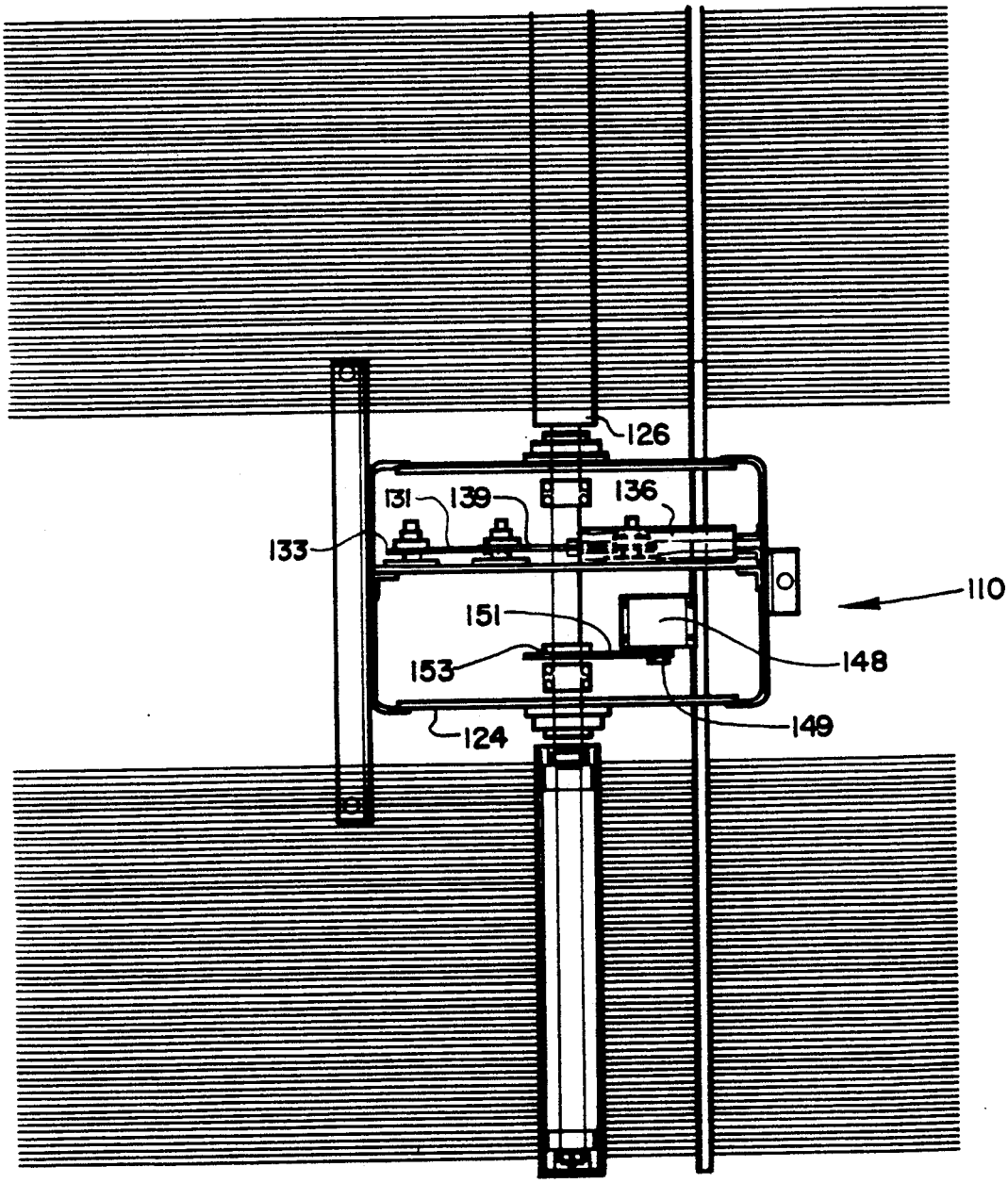
FIG. 6 is a top plan view of the yarn tension controlling apparatus of FIG. 5.

With reference now to FIGS. 5 and 6, an alternate embodiment of the yarn tension controlling apparatus of the present invention is indicated generally at 110. The tension controlling apparatus 110 has an upstanding central frame 124 by which a driven roll 126 and an idler roll 128 are rotatably supported in outwardly extending cantilevered fashion from each opposite side of the frame 124 for training of the yarns F in sequence peripherally about the rollers 126, 128. The driven roll 126 is mounted generally centrally of the frame 24 for driven rotation about a stationary axis by a variable speed drive motor, omitted for sake of clarity. The idler roll 128 is supported below the driven roll 126 at the free end of a depending arm assembly 129 pivotably supported at its opposite end coaxially with the stationary driven roll 126. An endless timing chain 131 is trained about a series of toothed pulleys 133 rotatably mounted interiorly within the frame 124, one of the pulleys 133' being fixed coaxially with the pivot arm assembly 129 for integral rotation therewith. A piston-and-cylinder assembly 136 is mounted horizontally within the frame 124 alongside the upper horizontal run of the endless chain 131, with the cylindrical housing 138 of the piston-and-cylinder assembly 136 being fixed with respect to the frame 124 and with an operating arm 139 of the piston projecting rearwardly from the cylindrical housing 138 and being fixed to the upper run of the endless chain 131. The housing 138 of the piston-and cylinder assembly 136 is provided with fittings at its opposite ends for admitting and exhausting operating fluid, e.g. pressurized air, into and from interior chambers at opposite sides of the piston. An electronic position potentiometer 148 is also mounted within the frame 124 and has a rotatable operating shaft 149 with an endless belt 151 being trained peripherally about the operating shaft !49 and about a pulley 153 mounted coaxially with the pivot axis of the arm assembly 129 for rotation integrally with the arm assembly 129 and with the pulley 133'.

In operation, yarns F are trained in series peripherally about the driven and idler rolls 126, 128, the driving rotating of the driven roll 126 imparting traveling movement to the yarns F, which, in turn drive rotation of the idler roll 128. Pressurized air is supplied to the rearward chamber of the piston-and-cylinder assembly 136 to apply a substantially constant biasing force urging retraction of the piston arm 139 and, in turn, urging pivotal movement of the arm assembly 129 and the idler roll 128 as a unit in a clockwise direction (as viewed in FIG. 5) for engaging the idler roll 128 with the traveling yarns F. The amount of the biasing force thusly exerted by the piston-and cylinder assembly 136 is set at the predetermined level of tension desired in the yarns F so that, so long as the yarn tension remains constant at such predetermined amount, the biasing force will exactly counteract the yarn tension to maintain the idler roll 128 substantially stationary vertically below the driven roll 126. However, in the event the tension in the yarns F decreases below the predetermined tension level, the biasing force of the piston-and-cylinder assembly 136 will cause the arm assembly 129 and the idler roll 128 to pivot in a clockwise direction (as viewed in FIG. 5), in turn rotating the pulley 153 to drive corresponding rotation of the operating shaft 149 of the potentiometer 148 through the belt 151. In like manner, increases in the yarn tension above the desired amount overcome the biasing force of the piston-and-cylinder assembly 136 to produce counterclockwise pivoting of the arm assembly 129 and the second idler roll 128 to produce opposite rotation of the potentiometer's operating shaft 149. As in the first embodiment, the potentiometer 148 produces a variable voltage output in relation to the rotational disposition of its operating shaft 149, with the output being supplied to a controller, such as the microprocessor 54, for producing corresponding changes in the driven speed of the driven roll 126 through variable speed control of its drive motor.

As will thus be understood, the yarn tension controlling apparatus of the present invention provides several important advantages. Most fundamentally, the present apparatus in both described embodiments provides a reliable means for maintaining a constant tensioning of a traveling yarn, e.g., a plurality of traveling yarns being delivered to a warp beaming machine in a textile warping system. Notably, by use of a piston-and-cylinder assembly in each embodiment for biasing the movable idler roll, the biasing force exerted is substantially constant at each position of the movable roll within the full range of its defined path of movement. By setting the biasing force at the desired yarn tension level and varying the driven speed of the driven roll in response to sensed tension fluctuations, the present apparatus advantageously imposes a minimal added frictional drag on the traveling movement of the yarns.

The first embodiment of FIGS. 204 provides the particular advantage of enabling the driven and idler rolls to be spaced a sufficient distance horizontally with respect to one another to function to accumulate a greater length of the traveling yarns between the creel 12 and the warp beaming machine 22 than the distance the yarns will travel during a stoppage of the apparatus from its full normal operating speed at a predetermined normal rate of braking. As those persons skilled in the art will recognize, this capability is particularly important in winding operations such as conventional warping systems which operate at relatively high yarn traveling speeds. In conventional warping systems, the warp beaming machine is placed at a sufficient distance from the creel to accommodate the braking of the traveling yarns in the event of a system stoppage. In contrast, the ability of the present apparatus to accumulate within itself substantially the same length of yarns enables a warping system utilizing the present tension controlling apparatus to be of a substantially lesser overall length. Further, the mounting of the movable idler roll for horizontal travel insures a uniform gravitational affect on the roll throughout the full range of movement.

With respect to the second embodiment of FIGS. 5 and 6, the mounting of the movable idler roll for pivoting concentrically about the rotational axis of the stationary idler roll provides a novel self-dampening of pivotal movements of the movable idler roll. Specifically, as will be understood with reference to FIG. 5, clockwise pivoting of the movable idler roll about the stationary driven roll in response to yarn tension decreases naturally produces an increasing angular degree of yarn wrapping about the pivoting roll which, in turn, produces a correspondingly increasing resistance to further clockwise pivoting movement of the roll. Conversely, counterclockwise pivoting movement of the movable roll about the stationary roll in response to yarn tension increases produces a decreasing angular degree of yarn wrapping about the pivoting roll to correspondingly decrease resistance to further pivoting movement of the roll.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. For example, the driven roll may be arranged either upstream or downstream of the idler roll, and driven and idler rolls need not necessarily be mounted within or a part of the same structure. By way of example and without limitation, the movable idler roll could be arranged, as illustrated in the drawings, in any textile warping system in advance of the warp beaming machine and its tension responsive movements utilized to control the driven speed of the warp beam in the warp beaming machine. In a textile draw warping system, it is contemplated that the movable idler roll could be similarly situated, with its tension responsive movements being utilized to control the driven speed of one or more driven rolls in the upstream draw unit. On the other hand, this invention is not limited to use in textile warping systems but instead is contemplated to have broad utility for controlling tension fluctuations in one or more yarns in any textile yarn handling system involving lengthwise transport of a yarn from one location to another. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a textile warping system, a yarn handling unit having a plurality of yarn engaging rolls for training of a plurality of yarns to travel in side-by-side relation in series peripherally about said rolls, said yarn handling unit having a central frame supporting said rolls extending in a cantilevered manner outwardly from each opposite side of said frame.

2. A textile yarn handling apparatus having a central frame with opposite sides and having at least one yarn engaging roll for training of yarn to travel peripherally about said roll, said roll extending in a cantilevered manner outwardly from each opposite side of said frame.

* * * * *